US008435161B2

(12) United States Patent
Xu

(10) Patent No.: US 8,435,161 B2
(45) Date of Patent: May 7, 2013

(54) BALANCE SIMULATOR FOR BICYCLING

(76) Inventor: Feng Xu, Fu-Cho (CN)

( * ) Notice: Subject to any disclaimer, the term of this patent is extended or adjusted under 35 U.S.C. 154(b) by 555 days.

(21) Appl. No.: 12/678,904

(22) PCT Filed: Sep. 17, 2008

(86) PCT No.: PCT/CN2008/072378

§ 371 (c)(1),
(2), (4) Date: Mar. 18, 2010

(87) PCT Pub. No.: WO2009/036699

PCT Pub. Date: Mar. 26, 2009

(65) Prior Publication Data

US 2010/0216103 A1 Aug. 26, 2010

(30) Foreign Application Priority Data

Sep. 18, 2007 (CN) ..... 2007 1 0121938

(51) Int. Cl.
*A63B 69/16* (2006.01)

(52) U.S. Cl.
USPC ..... 482/61; 434/247

(58) Field of Classification Search ..... 434/247; 482/61
See application file for complete search history.

(56) References Cited

U.S. PATENT DOCUMENTS 642,919 A * 2/1900 Nott ..... 482/59
2,534,967 A * 12/1950 Hapman ..... 482/61
3,667,316 A * 6/1972 Valletti et al. ..... 74/560
3,675,362 A * 7/1972 De Gelder et al. ..... 446/83
3,905,597 A * 9/1975 Tabb ..... 482/61
4,026,546 A * 5/1977 Omori ..... 482/61
4,045,678 A * 8/1977 Rickard ..... 378/174
4,082,308 A * 4/1978 Hug ..... 280/296
4,415,152 A * 11/1983 Smith ..... 482/61
4,802,666 A * 2/1989 Rodriqguez ..... 482/61
4,958,832 A 9/1990 Kim
5,938,551 A * 8/1999 Warner ..... 474/111
5,964,437 A * 10/1999 Belokin et al. ..... 248/205.5
6,126,571 A 10/2000 Parks
6,530,864 B1 * 3/2003 Parks ..... 482/4

(Continued)

FOREIGN PATENT DOCUMENTS

CN 2792565 Y 7/2006
WO 2006115340 A1 11/2006

*Primary Examiner* — Gene Kim
*Assistant Examiner* — Joseph B Baldori

(57) ABSTRACT

A balance simulator for bicycling comprises a base (4) and a roller device. A guide rail (20) is provided on the top surface of the base (4), and a removable board (3) is mounted on the guide rail (20). A rotatable plate vertical shaft (10) on top of which a rotatable plate (2) pivots is provided vertically on the middle part of the removable board (3), and a groove (6) for holding the bicycle front wheel (1) is provided longitudinally on the top surface of the rotatable plate (2). A semicircular inner gear (5) is installed on the foreside of the bottom surface of the rotatable plate (2), and the central lines of the semicircular inner gear (5) and the rotatable plate vertical shaft (10) are collinear. The semicircular inner gear (5) is engaged with a small gear (7) on the top of a gear shaft (8) which is mounted rotatably on the middle front part of the removable board (3). A big gear (16) is provided on the lower part of the gear shaft (8) and is engaged with a long rack (19) which is mounted on the middle part of the base (4).

5 Claims, 3 Drawing Sheets

U.S. PATENT DOCUMENTS

| | | | | |
|---|---|---|---|---|
| 6,857,992 | B1 * | 2/2005 | Kolda et al. | 482/61 |
| 7,060,009 | B2 * | 6/2006 | Greenleaf | 482/61 |
| 7,083,551 | B1 * | 8/2006 | Lassanske et al. | 482/61 |
| 7,226,395 | B2 * | 6/2007 | Wu et al. | 482/57 |
| 7,303,510 | B2 * | 12/2007 | Gebhardt | 482/61 |
| 7,604,575 | B2 * | 10/2009 | Papadopoulos | 482/61 |
| 7,942,790 | B2 * | 5/2011 | Papadopoulos | 482/61 |
| 2004/0053751 | A1 * | 3/2004 | Pizolato | 482/61 |
| 2004/0168842 | A1 * | 9/2004 | Chuan | 180/65.2 |
| 2004/0198562 | A1 * | 10/2004 | Greenleaf | 482/61 |
| 2007/0010377 | A1 * | 1/2007 | Wu et al. | 482/61 |
| 2007/0060453 | A1 * | 3/2007 | Papadopoulos | 482/61 |
| 2007/0202998 | A1 * | 8/2007 | Wan | 482/61 |
| 2009/0264261 | A1 * | 10/2009 | Papadopoulos | 482/61 |
| 2011/0136630 | A1 * | 6/2011 | Zwinkels | 482/61 |
| 2011/0218080 | A1 * | 9/2011 | Papadopoulos | 482/61 |
| 2012/0224940 | A1 * | 9/2012 | Andrews | 414/426 |

* cited by examiner

BALANCE SIMULATOR FOR BICYCLING

BACKGROUND OF THE INVENTION

1. Field of the Invention

The present invention relates to a device assisting the user in bicycling, and specifically, to a balance simulator for bicycling.

2. Related Prior Art

The prior art discloses a training device for bicycling. The training device has a plurality of driving device such as a front roller, a belt wheel and a belt all of which are supposedly mounted on a front wheel of a bicycle. Such a configuration makes the training device difficult to apply to different-sized bicycles, because the front wheel of the bicycle might be mounted at higher level so that the user is riding at higher level. The structure of the front roller of the front wheel also tends to separate from the front wheel due to excessively high gearing angle, causing danger in use. The belt wheel and the belt of a currently available training device for bicycling sometimes run at very high linear speed, which threatens the use safety. The current training device for bicycling usually has a great number of rollers and therefore needs larger force to drive the rollers to rotate, so that elders and children are not suitable for that kind of training device. Furthermore, the bulky volume and heavy weight are not in favor of travelling.

The present invention is therefore intended to obviate or at least alleviate the problems encountered in prior art.

SUMMARY OF THE INVENTION

It is an objective of the present invention to provide a light-weight, compact, convenient-to-carry, safe and force-saving balance simulator for bicycling, which can apply to all sizes of bicycle with good performance.

In order to achieve the above and other objectives, the balance simulator for bicycling according to the invention includes a base, a removable board, and a roller device mounted at the rear of the base for holding a bicycle rear wheel. A top surface of the base has guide rails. The removable board is mounted on the guide rails in a manner to move along the guide rails. A rotatable plate vertical shaft on top of which a rotatable plate pivots is provided vertically on a middle part of the removable board. A groove for holding a bicycle front wheel is provided longitudinally on the top surface of the rotatable plate. A semicircular inner gear is installed on a foreside of the bottom surface of the rotatable plate, and the central lines of the semicircular inner gear and the rotatable plate vertical shaft are collinear. The semicircular inner gear is engaged with a small gear on the top of a gear shaft which is mounted rotatably on the middle front part of the removable board. A big gear is provided on the lower part of the gear shaft and is engaged with a long rack which is longitudinally mounted on the middle part of the base at right and left side.

In the balance simulator for bicycling, the groove has cross-sectional shape of triangle or ladder with a wide top and a narrow bottom. The cross-section taken along the from the front to the rear of the balance simulator has a semicircular shape. The bottom surface of the base has a plastic pad a bottom surface of which has a plurality of vacuum suction plates.

In the balance simulator for bicycling, on the middle part of the removable board is mounted a bearing base having holes in parallel. The rotatable plate vertical shaft and the gear shaft are respectively on the shaft base in parallel by using two bearings.

In the balance simulator for bicycling, each of four corners at the lower surface of the removable board are respectively mounted with a roller through a roller shaft. The rollers move along the guide rails. The middle part of the lower surface of the removable board is mounted with a slipping-proof hook in a manner that a hook head of the slipping-proof hook matches the bottom surface of the long rack. A lower part of the gear shaft is mounted with a slipping-proof threaded screw cap a big part of which matches the bottom surface of the middle part of the base.

In the balance simulator for bicycling, each of the right and left sides of the base has a vertical limitation panel an inward surface of which is mounted with a buffer pad.

In the balance simulator for bicycling, the roller device includes a holder, and rollers rotatably mounted on a front and a rear of the holder along the left and right directions of the roller device.

The balance simulator for bicycling according to the invention offers advantages over the prior art. For example:

1. The balance simulator replaces the driving device on the conventional training device, so that more bicycles of different sizes can be used to the balance simulator, broadening its application scope.

2. The groove holding the bicycle front wheel is much closer to the ground than the front roller of the conventional training device which places the front wheel on the front roller, lowering the riding height level. Moreover, the front roller of the bicycle front wheel is substituted with the groove, overcoming the shortages of roller falling due to large gearing angle and thus enhancing the use safety.

3. Sometimes the belt wheel and the belt of the conventional training device have very high linear speed, threatening the use safety. Such a problem does exist anymore in the invention.

4. The balance simulator of the invention is light-weight and compact, compared to the prior art.

5. The balance simulator of the invention can be used for the bicycles with different wheel distances, as long as adjusting the distance between the base and the roller devices.

6. Reduced number of the rollers requires less force needed for driving the roller to rotate.

7. The balance simulator of the invention has competitive performance-price ratio compared to the prior art.

Other objectives, advantages and features of the present invention will become apparent from the following description referring to the attached drawings.

BRIEF DESCRIPTION OF THE DRAWINGS

The present invention will be described via detailed illustration of the preferred embodiment versus prior art referring to the drawings where.

DETAILED DESCRIPTION OF THE INVENTION

Figure 1:
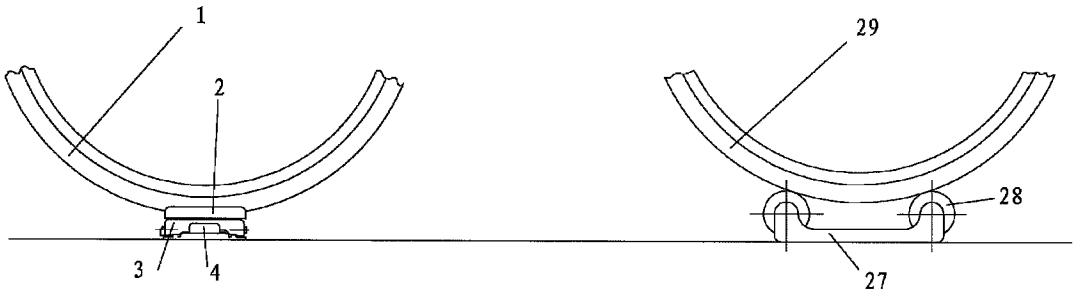
FIG. 1 is a schematic side view of a balance simulator for bicycling according to the invention.

As shown in FIG. 1, a balance simulator for bicycling according to the invention including a base 4, a removable board 3, and a roller device located a rear of the base 4 for holding the bicycle rear wheel 29.

Figure 2:
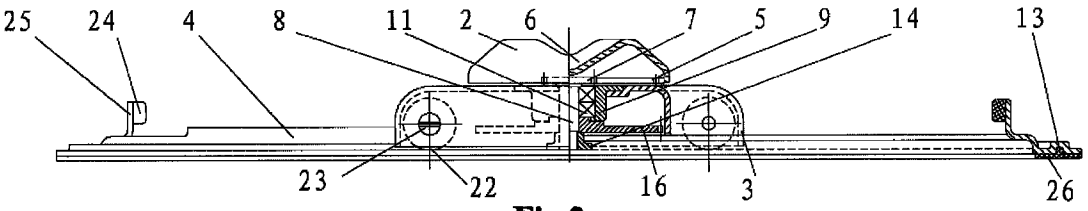
FIG. 2 is a schematic view of base a balance simulator for bicycling according to the invention.
Figure 3:
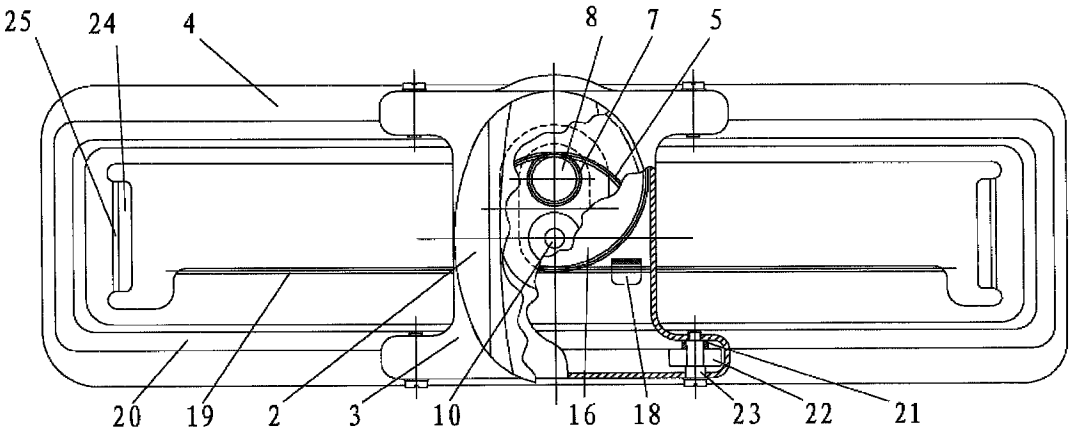
FIG. 3 is a top view of FIG. 2.
Figure 4:
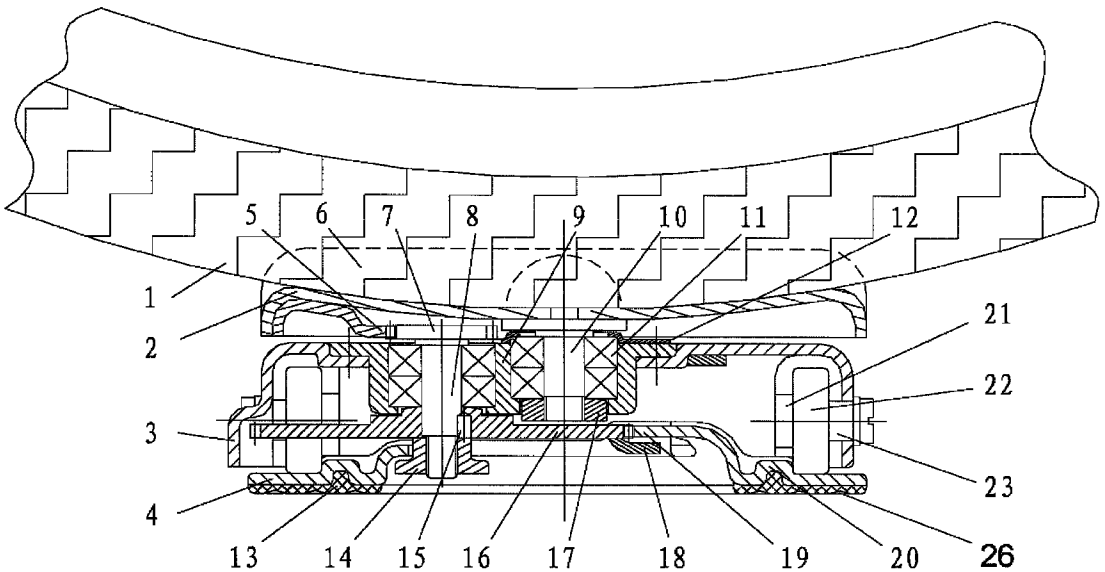
FIG. 4 is an enlarged view of FIG. 2.

As shown in FIG. 2, FIG. 3, and FIG. 4, a top surface of the base 4 has no guide rails 20. The removable board 3 is mounted on the guide rails 20 in a manner to move along the guide rails 20. A rotatable plate vertical shaft 10 on top of which a rotatable plate 2 pivots is provided vertically on a middle part of the removable board 3. A groove 6 for holding the bicycle front wheel 1 is provided longitudinally on the top surface of the rotatable plate 2.

As shown in FIG. 3 and FIG. 4, a semicircular inner gear 5 is installed on a foreside of the bottom surface of the rotatable plate 2 of the balance simulator for bicycling according to the invention. The central lines of the semicircular inner gear 5 and the rotatable plate vertical shaft 10 are collinear. The semicircular inner gear is engaged with a small gear 50 on the top of a gear shaft 8 which is mounted rotatably on the middle front part of the removable board 3. A big gear 16 is provided on the lower part of the gear shaft 8 and is engaged with a long rack 19 which is longitudinally mounted on the middle part of the base 4 at right and left side. A round pin 15 or a flat pin is used to fix the big gear 16 and the gear shaft 8. The groove 6 holding the bicycle front wheel is much closer to the ground than the front roller of a conventional training device which places the front wheel on the front roller, lowering the riding height level. Moreover, the front roller of the bicycle front wheel is substituted with the groove, overcoming the shortages of roller falling due to large gearing angle and thus enhancing the use safety.

The feature of the groove 6 has cross-sectional shape of triangle or ladder with a wide top and a narrow bottom. Furthermore, the cross-section taken along the from the front to the rear of the balance simulator has a semicircular shape. The cross-sectional shape of triangle or ladder of the groove 6 allows the groove 6 to receive the bicycle front wheel 1 of different sizes, and further broadens the application scope thereof.

As shown in FIG. 4, the bottom surface of the base 4 of the balance simulator for bicycling according to the invention has a plastic pad 13 a bottom surface of which has a plurality of vacuum suction plates 26. When the base 4 is placed onto a smooth ground, the vacuum suction plates 26 sucks on the base 4 to the ground and thus prevents the base 4 from moving along the ground.

On the middle part of the removable board of the balance simulator for bicycling according to the invention is mounted a bearing base 9 having holes in parallel. The rotatable plate vertical shaft 10 and the gear shaft 8 are respectively on the shaft base 9 in parallel by using two bearings 11. On the top of the shaft base 9 is located a bearing cover 12 to fix the bearing 11. Each of four corners at the lower surface of the removable board 3 are respectively mounted with a roller 22 through a roller shaft 23 on which is sleeved with a roller sleeve 21 for positioning the roller 22. The rollers 22 move along the guide rails 20. The middle part of the lower surface of the removable board 3 is mounted with a slipping-proof hook 18 in a manner that a hook head of the slipping-proof hook matches the bottom surface of the long rack 19 in order to prevent the removable board 3 from turning over and slipping from the base 4. A lower part of the gear shaft 8 is mounted with a slipping-proof threaded screw cap 14 a big part of which matches the bottom surface of the middle part of the base 4. When the removable board 3 turns over and slips from the base 4 under the action of an external force, the hook head of the slipping-proof hook 18 attaches to the lower surface of the long rack 19. The big part of the slipping-proof threaded screw cap 14 in turns attaches to the lower surface of the middle part of the base 4, further stopping the removable board 3 from separating from the base 4.

As shown in FIG. 2, in the balance simulator for bicycling, each of the right and left sides of the base 4 has a vertical limitation panel 25 for preventing the removable board 3 from separating from the guide rails 20. An inward surface of each limitation panel 25 is mounted with a buffer pad 24 for buffering the collision of the limitation panels 25 from the removable board 3.

As shown in FIG. 1, in the balance simulator for bicycling, the roller device includes a holder 27, and rollers 28 rotatably mounted on a front and a rear of the holder 27 along the left and right directions of the roller device. The distance between two rollers 28 is adjustable.

When the balance simulator for bicycling according to the invention is in use and the user does not gear the bicycle handle, the removable board 3 locates at the middle part of the base 4. When the user counterclockwise to gear the handle of the bicycle, the bicycle front wheel 1 in the groove 6 of the upper surface of the rotatable plate 2 will drive the rotatable plate 2 to rotate counterclockwise around the rotatable plate vertical shaft 10. Therefore, the small gear 7 engaged with the semicircular inner gear 5 will rotate counterclockwise under the action of the semicircular inner gear 5, driving the gear shaft 8 to rotate clock wisely. Therefore, the big gear 16 provided on the lower part of the gear shaft 8 moves left along the long rack 19, pushing the whole removable board 3 on the base 4 to move left along the guide rails 20. A balance simulated movement is thereby realized.

When the user gears clockwise the bicycle handle, the bicycle front wheel 1 in the groove 6 of the upper surface of the rotatable plate 2 will drive the rotatable plate 2 to rotate clockwise around the rotatable plate vertical shaft 10. Therefore, the small gear 7 engaged with the semicircular inner gear 5 will rotate clockwise under the action of the semicircular inner gear 5, driving the gear shaft 8 to rotate counterclockwise. Therefore, the big gear 16 provided on the lower part of the gear shaft 8 moves right along the long rack 19, pushing the whole removable board 3 on the base 4 to move right along the guide rails 20. A balance simulated movement is thereby realized.

The balance simulator for bicycling according to the invention replaces the driving device on the conventional training device, so that more bicycles of different sizes can be used to the balance simulator, broadening its application scope. The groove holding the bicycle front wheel is much closer to the ground than the front roller of the conventional training device which places the front wheel on the front roller, significantly lowering the riding height level. Moreover, the front roller of the bicycle front wheel is substituted with the groove in balance simulator of the invention, overcoming the shortages of roller falling due to large gearing angle and thus enhancing the use safety. The light-weight and compact character the balance simulator of the invention imparts convenience in storage and travelling.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A balance simulator for bicycling, comprising a base, a removable board, and a roller device mounted at the rear of the base for holding a bicycle rear wheel, wherein each of the right and left sides of the base has a vertical limitation panel an inward surface of which is mounted with a buffer pad; a top surface of the base has guide rails; the removable board is mounted on the guide rails in a manner to move along the guide rails; a rotatable plate vertical shaft on top of which a rotatable plate pivots is provided vertically on a middle part of the removable board; a groove for holding a bicycle front wheel is provided longitudinally on the top surface of the rotatable plate; a semicircular inner gear is installed on a foreside of the bottom surface of the rotatable plate; the central lines of the semicircular inner gear and the rotatable plate vertical shaft are collinear; the semicircular inner gear is engaged with a small gear on the top of a gear shaft which is mounted rotatably on the middle front part of the removable board; a big gear is provided on the lower part of the gear shaft and is engaged with a long rack which is longitudinally mounted on the middle part of the base at right and left side.

2. The balance simulator for bicycling according to claim 1, wherein the feature of the groove has cross-sectional shape of triangle or ladder with a wide top and a narrow bottom, the cross-section of the groove taken along the from the front to the rear of the balance simulator is semicircular, and the bottom surface of the base has a plastic pad a bottom surface of which has a plurality of vacuum suction plates.

3. The balance simulator for bicycling according to claim 2, wherein on the middle part of the removable board is mounted a bearing base having holes in parallel, and the rotatable plate vertical shaft and the gear shaft are respectively on the shaft base in parallel by using two bearings.

4. The balance simulator for bicycling according to claim 1,2 or 3, wherein each of four corners at the lower surface of the removable board are respectively mounted with a roller through a roller shaft, the rollers move along the guide rails; the middle part of the lower surface of the removable board is mounted with a slipping-proof hook matches the bottom surface of the long rack; and a lower part of the gear shaft is mounted with a slipping-proof threaded screw cap a big part of which matches the bottom surface of the middle part of the base.

5. The balance simulator for bicycling according to claim 1, wherein the roller device includes a holder, and rollers rotatably mounted on a front and a rear of the holder along the left and right directions of the roller device, and the distance between two roller is adjustable.

* * * * *